US005104108A

United States Patent [19]

Honegger

[11] Patent Number: 5,104,108

[45] Date of Patent: Apr. 14, 1992

[54] APPARATUS FOR COLLECTING, ASSEMBLING AND INSERTING PRINTERY PRODUCTS

[75] Inventor: Werner Honegger, Tann Ruti, Switzerland

[73] Assignee: Ferag AG, Hinwil, Switzerland

[21] Appl. No.: 365,616

[22] Filed: Jun. 13, 1989

[30] Foreign Application Priority Data

Jun. 14, 1988 [CH] Switzerland ..... 02285/88

[51] Int. Cl.[5] ..... B65H 5/30

[52] U.S. Cl. ..... 270/55; 270/54; 270/57

[58] Field of Search ..... 270/54, 55, 57, 58

[56] References Cited

U.S. PATENT DOCUMENTS

| | | | |
|---|---|---|---|
| 3,122,362 | 2/1964 | Vollrath et al. . | |
| 3,938,799 | 2/1976 | Macke | 270/55 |
| 4,373,710 | 2/1983 | Hansen | 270/55 |
| 4,479,643 | 10/1984 | Seidel | 270/55 |
| 4,489,930 | 12/1984 | Meier . | |
| 4,706,951 | 11/1987 | Leu . | |
| 4,723,770 | 2/1988 | Seidel | 270/55 |
| 4,743,005 | 5/1988 | Reist | 270/55 |

FOREIGN PATENT DOCUMENTS

| | | |
|---|---|---|
| 0095603 | 12/1983 | European Pat. Off. . |
| 0218872 | 8/1986 | European Pat. Off. . |
| 370423 | 2/1960 | Fed. Rep. of Germany . |
| 594553 | 2/1976 | Switzerland . |

*Primary Examiner*—Edward K. Look
*Assistant Examiner*—Therese M. Newholm
*Attorney, Agent, or Firm*—Willian Brinks Olds Hofer Gilson & Lione

[57] ABSTRACT

Holding arrangements (20) are fixed to a circulating tension member (16). One saddle-shaped support (12) is arranged on each holding arrangement (20). The walls (42, 44) on these supports (12), in the area of the effective conveying stretch, define pocket-shaped receiving parts (46). The printery products (14) fed by a first feed conveyor (22) are each fed into a receiving part (46) and opened by an opening device so that the printery product (14') fed by a second feed conveyor (22') can be inserted into the first opened printery product (14). The printery products (14, 14') thus inserted one into the other are seized and carried away by grippers (28) of a removal conveyor (24). It is also possible for the opening device to be disengaged so that the printery products (14, 14') fed by both feed conveyors (22, 22') come to lie side by side in the receiving parts (46), which enables printery products (14, 14') to be assembled. Furthermore, the printery products (14) can be fed by the feed conveyors (22, 22') with their open side in front, the printery products (14) being opened by means of opening appliances (36) and being deposited astride onto the saddle-shape supports (12). The printery products (14) thus collected and lying one on top of the other are seized and transported away by the removal conveyor (24).

26 Claims, 4 Drawing Sheets

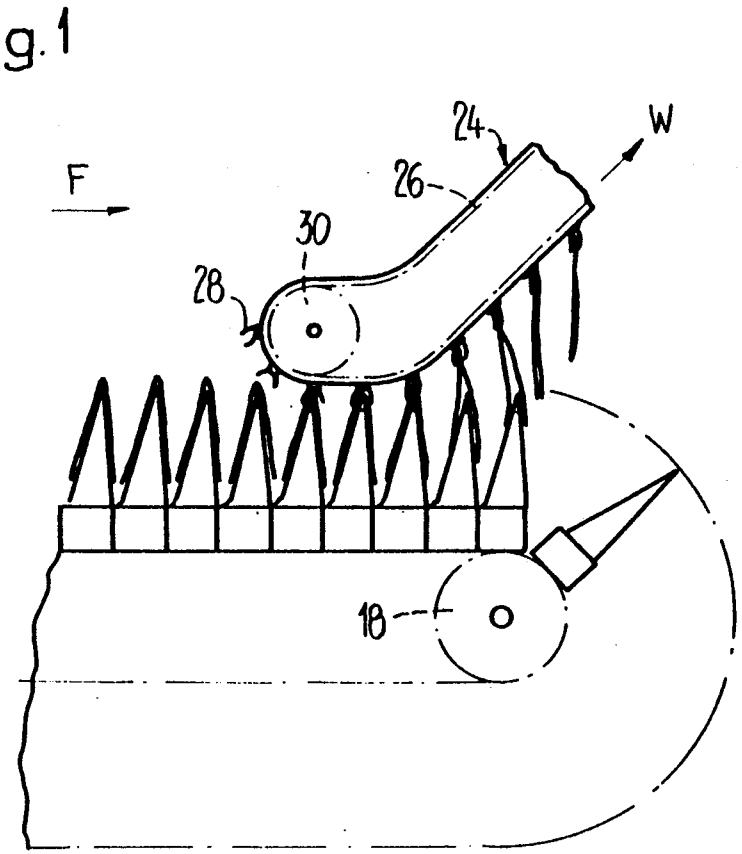
Fig. 1
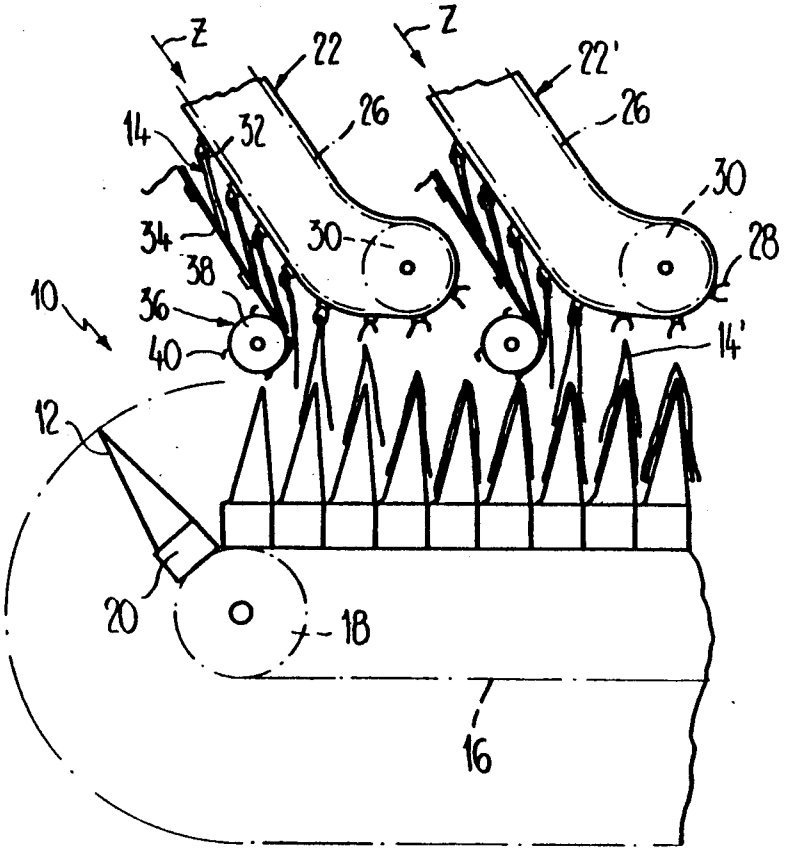

F2
46
12
42
58
44
86
74
84
82
72
57
80'
71'
14
14'
32
62
64
64'
68
70
66
48
20
60
78
76
88
90

14
14'
74
72
60

APPARATUS FOR COLLECTING, ASSEMBLING AND INSERTING PRINTERY PRODUCTS

BACKGROUND OF THE INVENTION

The present invention relates to an apparatus for collecting, assembling and inserting printery products according to the preamble of claim 1.

European Patent Application 0,095,603 and the corresponding U.S. Pat. No. 4,489,930 disclose an apparatus for collecting folded printery products in which a plurality of saddle-shaped supports are arranged like ladder rungs on two conveyor chains circulating in parallel. Arranged downstream from one another along the effective conveying upper strand are a plurality of feed locations at which folded printery products are deposited astride onto the supports. At the end of the effective conveying stretch, the collected printery products, thus deposited one on top of the other, are lifted off the supports and conveyed away by means of a withdrawal station.

Furthermore, European Patent Application 0,218,872 or the corresponding U.S. Pat. No. 4,706,951 discloses an apparatus for assembling printery products. This apparatus has a plurality of pocket-shaped receiving parts which are arranged transversely to the circulating direction on a circulating conveyor chain. Provided along the effective conveying stretch are a plurality of feed locations at which printery products are fed into the receiving parts. At the end of the effective conveying stretch, the printery products, thus assembled and arranged side by side in the receiving parts, are transferred together to a further-processing station by opening the base of the receiving parts.

Swiss Patent Specification 594,553 discloses a similar apparatus for inserting printery products This apparatus has pocket-shaped receiving parts which are arranged on a circulating tension member and into which a folded printery product is fed at a first feed location. In the course of the further transport to the next feed location, this printery product is opened by means of an opening device so that the printery products fed into the receiving parts at the next feed locations come to lie in this opened, first printery product. Arranged downstream from the feed locations is a withdrawal location at which the printery products inserted one into the other are released and fed to a further processing station by opening the base of the receiving parts.

In printeries or in works which process printery products such as bookbinderies, both actual collecting apparatuses as well as actual insertion or assembly apparatuses are required. Frequently, these apparatuses can therefore only be used from time to time.

The object of the present invention is therefore to reduce the plurality of different apparatuses and machines necessary in printeries and in works processing printery products and to increase the utilization of the machines available.

SUMMARY OF THE INVENTION

According to this invention an apparatus is provided for collecting, assembling and inserting printery products. This apparatus comprises a plurality of circulating, saddle-shaped supports, arranged transversely to a circulating direction and at a mutual distance apart, for collecting printery products along a processing path. The supports are directed upwardly in an area defined by the processing path. At least two feed locations are arranged at a distance from one another along the processing path, at which printery products can be deposited astride onto the supports or onto the printery products already deposited onto the supports. A removal location is arranged downstream from these feed locations, and a plurality of circulating receiving parts, closed off at a bottom portion and arranged transversely to the circulating direction, are provided for assembling or inserting printery products. These receiving parts are arranged along the processing path such that the openings of the receiving parts are directed upward in the area of the processing path and printery products can be fed into the receiving parts at the feed locations.

With a single apparatus according to the invention, printery products can thus be collected as well as inserted and assembled. The receiving parts and supports can be firmly mounted on the apparatus. But it is also conceivable for the receiving parts and/or the supports to be removable from holding arrangements. This also enables the supports to be interchanged with the receiving parts. Thus, after a short change-over time, printery products can be collected, inserted or assembled by the apparatus.

In a further embodiment, the supports and receiving parts are provided on a carousel-like supporting arrangement rotatable about an essentially vertical axis. The feed locations and the withdrawal location are then arranged in the peripheral area of this supporting arrangement.

In an especially preferred embodiment, the receiving parts and supports are alternately arranged one behind the other as viewed in the direction of the processing path. The walls, facing one another, of two adjacent receiving parts are advantageously covered by a support or the latter is in alignment with the walls. Thus the free ends of the folded printery products, deposited onto the supports, can slide into the receiving parts without problem; the same also applies of course to the printery products fed into these receiving parts during insertion or assembly.

A second feature of this invention, which can be used independently of the first feature described above, relates to an opening device for opening at least a first printery product disposed in a pocket-shaped receiving part, in order to allow further printery products to be inserted into the first, open printery product. This opening device is used with pocket-shaped receiving parts which define a closed bottom portion and with first printery products that define a fold and rest with the fold on the closed bottom portion. The fold is positioned to define one part of the printery product, which at an open lateral edge opposite the fold has a marginal section protruding relative to another part. The opening device of this invention comprises at least one opening member which can be moved from a product-hold open-position into a product-closed position and back again, and on which a driving element is provided for detachably holding the one part of the product in position.

An opening device is allocated in a preferred manner to each receiving part. This enables folded printery products fed in the closed state to be opened so that a printery product fed next can be inserted into this first opened printery product. A preferred embodiment of the opening device is described below.

BRIEF DESCRIPTION OF THE DRAWINGS

The invention will now be described in greater detail with reference to two examples shown in the drawing, in which, purely schematically:

FIG. 1, in side view, shows a first exemplary embodiment of an apparatus according to the invention during the collection of printery products.

DETAILED DESCRIPTION OF THE PRESENTLY PREFERRED EMBODIMENT

Figure 2:
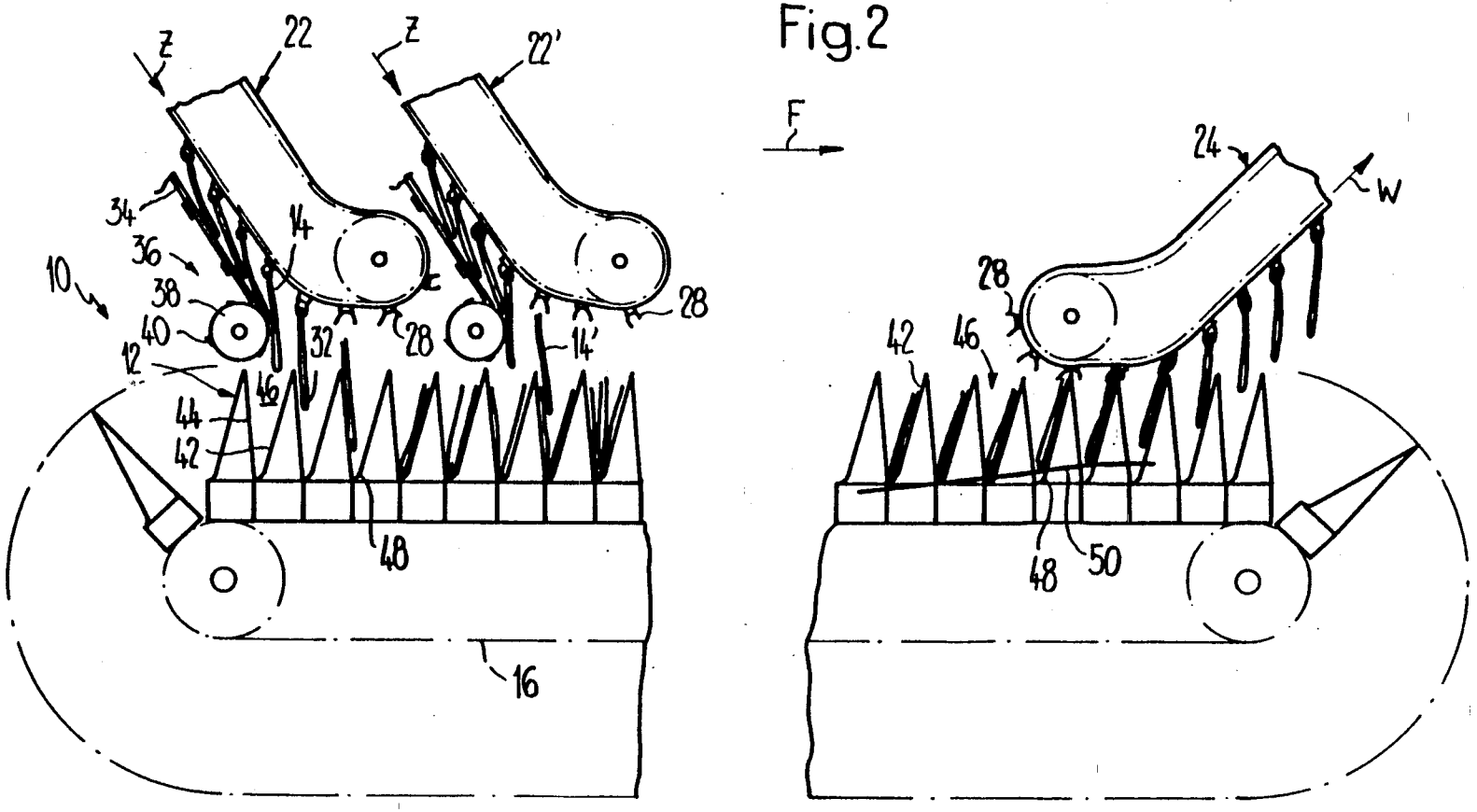
FIG. 2 shows the same exemplary embodiment as FIG. 1 during the insertion of printery products, FIG. 3, in elevation, shows a saddle-shaped support, FIG. 4, in side view and simplified representation, shows a second exemplary embodiment of an apparatus according to the invention, FIGS. 5 and 6, in side view and enlarged representation, show a detail from FIGS. 2 and 1 respectively.

FIG. 1 schematically indicates in side view a transport appliance 10, shown interrupted, having saddle-shaped supports 12 for collecting folded printery products 14, 14'. The transport appliance 10 has two traction members 16 (conveyor chains) driven in a circulating manner parallel to one another in conveying direction F and indicated by dot-dash lines, of which tension members 16 only one can be seen. The tension members 16 at the start and end of the effective conveying stretch are guided in a known manner around sprocket wheels 18 which are mounted in a fixed position and of which at least one is driven. Fixed to the tension members 16 are holding arrangements 20 on which the supports 12, running at right angles to the conveying direction F, sit. It should be noted that the holding arrangements 20 bear laterally against one another on the rectilinear effective conveying stretch, whereas they are swung apart in a V-shape in the area of the sprocket wheels 18.

Two feed conveyors 22, 22' are shown at the start of the effective conveying stretch and a removal conveyor 24 is shown at the end of the effective conveying stretch. The feed conveyors 22, 22' and the removal conveyor 24 are essentially of the same construction and each have individually controllable grippers 28 arranged on a tension member 26 indicated by dot-dash lines and driven in a circulating manner in feed direction Z or removal direction W. The tension members 26 (conveyor chains) are guided in the area of the transport appliance 10 around sprocket wheels 30 mounted in a fixed position, and the mutual distance apart of the grippers 28 is essentially the same as the distance between the supports 12. It should be noted that only two feed conveyors 22, 22' are shown in FIG. 1, but further feed conveyors 22' can be provided in the part shown interrupted.

Each gripper 28 of the feed conveyors 22, 22' which is guided toward the transport appliance 10 seizes a printery product 14, 14' at its trailing (as viewed in feed direction Z) fold 32. Located in front of the transport appliance 10 in each case is a guide plate 34 which runs essentially parallel to the feed direction Z, is arranged beneath the feed conveyors 22, 22' and feeds to one opening appliance 36 each the leading edges of the printery products 14, 14' sliding on it. The opening appliances 36 each have a rotatably mounted opening roller 38 which is driven in a circulating manner and is provided with controllable clamps 40. The leading edge of the printery products 14, 14' in each case sliding on the guide plate 34 is seized by a clamp 40 and held on the circumferential surface of the opening roller 38. The leading edge thus held in position is lifted off the other leading edge of the printery product 14, 14' so that the latter is opened. A support 12 travels into each opened printery product 14, 14', the leading edge held in position by the clamp 40 is then released, the corresponding gripper 28 of the feed conveyor 22, 22' is opened and the printery product 14, 14' drops astride onto the support 12.

The opened grippers 28 of the removal conveyor 24 each pass into the area of a support 12, where they are transferred into their closing position and thus clamp in place the printery products 14, 14' arranged on a support 12, lift the printery products off the support 12 and carry them away in conveying direction W.

The apparatus shown in FIG. 1 functions as follows:

An opened printery product 14 is deposited astride by the first feed conveyor 22 onto each support 12 running through beneath the said conveyor. This printery product 14 is transported in conveying direction F to the next feed conveyor 22', where a further opened printery product 14' is deposited astride onto this printery product 14. In an analogous manner, further printery products 14' can be deposited by further feed conveyors 22' (not shown) onto the printery products 14, 14' already lying astride one on top of the other. The printery products 14, 14' thus collected pass to the removal conveyor 24, where they are seized by the grippers 28 and transported away in a collected manner.

Shown in FIG. 2 are the same transporting device 10, the same feed conveyors 22, 22' and the same removal conveyor 24 as in FIG. 1. They are only described in greater detail insofar as this is necessary to understand FIG. 2.

In the area of the effective conveying stretch, the trailing wall 42 of each support 12, in each case with the leading wall 44 of the rear (as viewed in conveying direction F) support 12, forms a pocket-shaped receiving part 46 which is closed off at the bottom by a base 48. The opening appliance 36 is disengaged and the clamps 40 are transferred into their closing position bearing against opening roller 38. Each gripper 28 of the feed conveyor 22, 22' seizes a printery product 14, 14' at its trailing (as viewed in feed direction Z) edge, the fold 32 now leading and sliding on the guide plate 34. The printery products 14, 14' are thus fed with their fold 32 in front into the receiving parts 46, where they come to bear on the base 48 of the receiving parts 46 or on the opened printery product 14 fed in first.

Provided toward the end of the effective conveying stretch of the transport appliance 10 is a further guide plate 50 arranged in the area of the bases 48 of the receiving parts 46 and, as viewed in conveying direction F, rising toward the removal conveyor 24. The printery products 14 coming to bear with their fold 32 against this guide plate 50 are lifted toward the removal conveyor 24 so that each gripper 28 of the removal conveyor 24 can in each case seize the printery products 14, 14' arranged in a receiving part 46 and transport them away in conveying direction W.

The apparatus according to FIG. 2 functions as follows:

A folded printery product 14, with its fold 32 in front, is in each case fed into a receiving part 46 by the first feed conveyor 22. After the respective gripper 28 has opened, the printery product 14 drops into the receiving part 46 until the fold 32 comes to bear on the base 48. This printery product 14, while being transported to the next feed conveyor 22', is opened by means of an opening device (not shown) so that the printery product 14' fed by the feed conveyor 22' is fed into the opened printery product 14. The printery products 14, 14' thus inserted one into the other are closed by means of the opening device in the course of the further transport to the removal conveyor 24 and thus come to bear against the respectively leading wall 42 of the receiving part 46. The grippers 28 seize the printery products 14, 14' raised by means of the guide plate 50 and inserted one into the other and convey them in direction W to a next processing station. It should be noted that further feed conveyors 22' which feed further printery products 14' which are inserted into the first opened printery product 14 can be provided between the second feed conveyor 22' and the removal conveyor 24.

The apparatus according to FIG. 2 can also be used for assembling printery products 14, 14'. During this procedure, a printery product 14 is fed into each receiving part 46 by the first feed conveyor 22. This printery product 14 now comes to bear in the closed state against one of the walls 42 or 44. This can be achieved, for example, by the leading wall 42 of the receiving parts 46, in the area of the effective conveying stretch, being inclined at a greater angle relative to the vertical than the trailing wall 44, which runs virtually in the vertical direction. However, this can also be achieved with the opening device described further below and required for inserting printery products 14, 14' by this opening device placing the printery products 14 against one of the walls 42 or 44 without opening these printery products 14. The printery products 14' fed into the receiving parts 46 by the second feed conveyor 22' thus come to bear beside the printery products 14. The printery products 14, 14' thus assembled are seized and carried away by the removal conveyor 24 in a manner analogous to that described further above in connection with the insertion.

Figure 3:
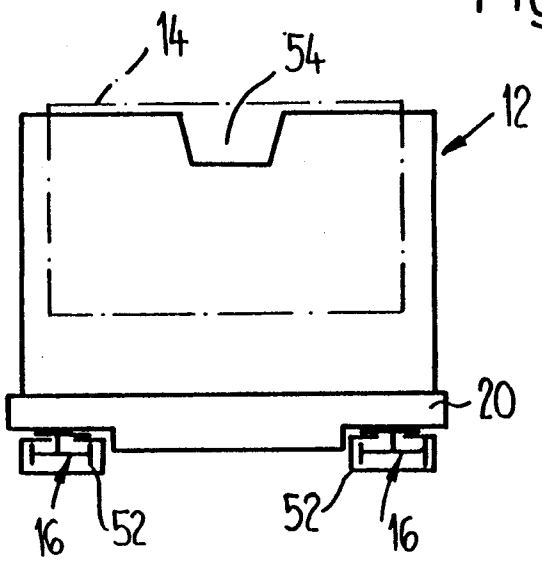

A support 12 from FIG. 1 is shown in elevation in FIG. 3. It is fixed to the beam-like holding arrangement 20 which, at its lateral end areas, sits on the tension members 16. The tension members 16 are formed by known link chains which are guided in C-shaped hollow sections 52. At its upper end area, the support 12 is provided with a recess 54 in the center. The latter is used to enable the grippers 28 of the removal conveyor 24 to seize the printery products 14, indicated by dot-dash lines and deposited astride onto the supports 12, without problem for transporting away.

Figure 4:
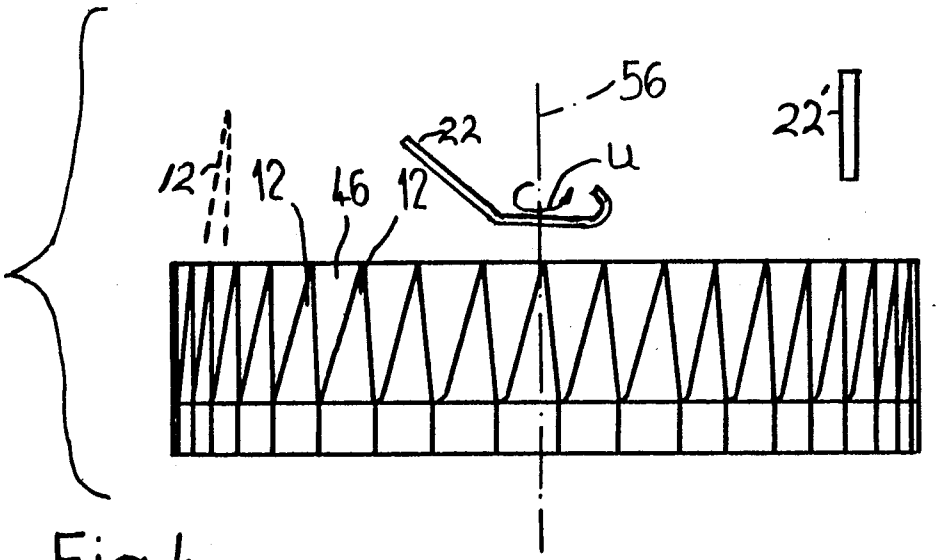

In an embodiment in FIG. 4, the supports 12 and receiving parts 46 are alternately arranged on a carousel-like supporting arrangement. This supporting arrangement is rotatably driven about a vertical axis 56 in direction of rotation U. In such an arrangement, the feed conveyors 22, 22' and the removal conveyor 24 (see FIGS. 1 and 2) can be arranged in a tangential direction so that printery products 14, 14' can again be assembled in a collected manner or inserted one into the other with this apparatus.

Figure 5:
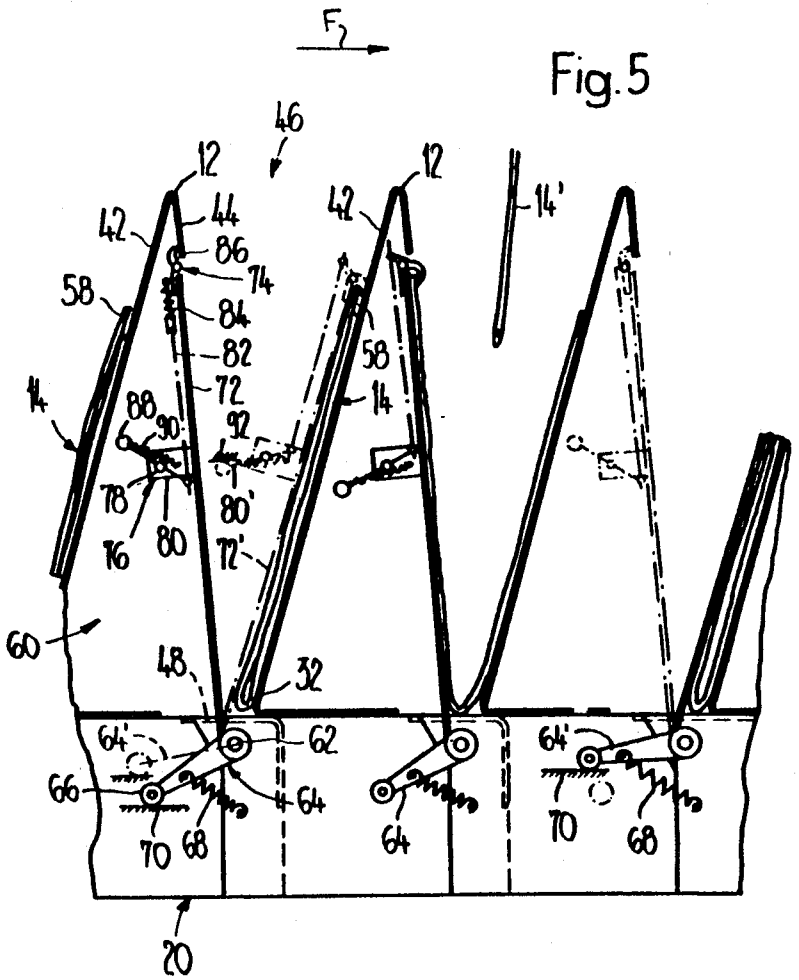
Figure 6:
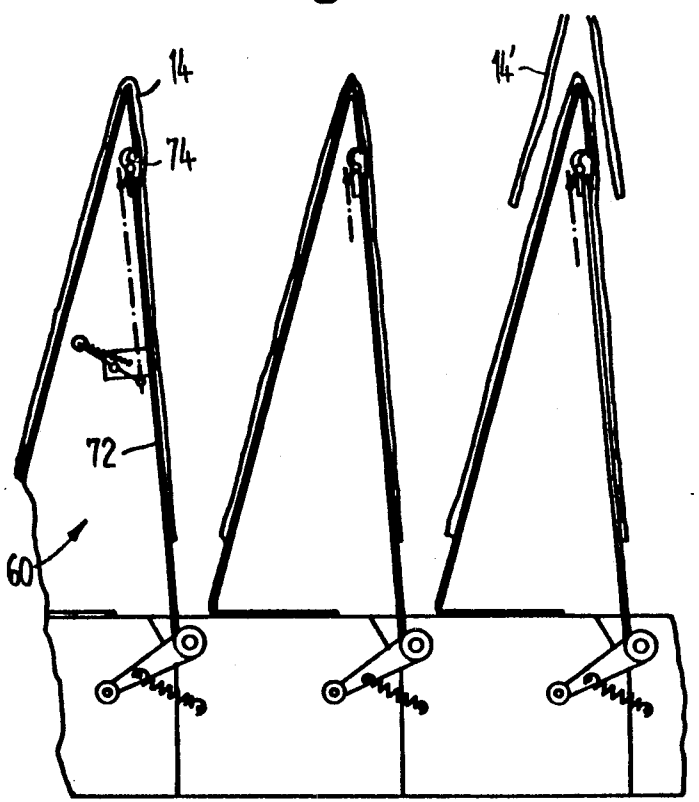

In an enlarged representation, FIGS. 5 and 6 show a part of the transport appliance 10 in the area of the second feed conveyor 22' in FIGS. 2 and 1. One saddle-shaped support 12 each is provided on the holding arrangements 20 bearing against one another, so that supports 12 and receiving parts 46 are formed alternately. The printery products 14 fed by the first feed conveyor 22 (see FIG. 2) are folded outside the center and, at their open lateral margin opposite the fold 32, have on one part a marginal section 58 which protrudes relative to the other part. The printery products 14 are fed by the feed conveyor 22 in such a way that they come to bear against the respectively leading wall 42 of the receiving parts 46, and the marginal section 58 is arranged on that part of the printery products 14 which faces the respectively trailing wall 44.

Arranged on each holding arrangement 20 is an opening device 60 which has a shaft 62 which is pivotably mounted on the upper, trailing (as viewed in conveying direction F) end area of the holding arrangement 20 and runs at right angles to the conveying direction F. The righthand (as viewed in conveying direction F) end area of the shaft 62, which end area can be seen in FIGS. 5 and 6, protrudes beyond the holding arrangement 20 and a drive lever 64 is in each case arranged rotationally fast on it. Rotatably mounted on the drive lever 64 at the free end, which, as viewed in conveying direction F, is directed toward the rear and downward, is a follower roller 66 which is pulled against the guide surface of a fixed link 70 by means of a tension spring 68 fixed at one end to the drive lever 64 and at other end to the holding arrangement 20. The drive lever 64 and thus also the shaft 62, by means of the link 70 and the tension spring 68, can be transferred from a product-hold-open position into the product-closed position, designated by 64', and back again. When the follower roller 66 runs off the link 70, the drive lever 64, by a stop (not shown) on the holding arrangement 20, is held in the product-hold-open position.

Arranged rotationally fast on the shaft 62 is an opening lever 72 on whose free end, protruding upward, a two-arm clamping lever 74 is pivotably mounted. The opening lever 72, by the pivoting of the shaft 62, can thus be transferred from a product-hold-open position, shown by solid lines, into a product-closed position, shown by a dot-dash lines and designated by 72', in which it runs approximately parallel to the wall 42. It should be noted that the opening lever 72, in its product-hold-open position, is swung into openings in the leading wall 44 of the support 12 arranged in the trailing (as viewed in conveying direction F) holding arrangement 20 so that the opening lever 72 together with the clamping lever 74 is covered by this wall 44 or is in alignment with it.

A control arrangement 76 for the clamping lever 74 is provided in the center area of the opening lever 72. This control arrangement 76 has an extension arm 78 which is fixed to the clamping lever 74 and on which a two-arm control lever 80 is pivotably mounted. Articulated on one end of the control lever 80 is a push rod 82 which, via a compression spring 84, acts on the end of the clamping lever 74 remote from the curved clamping end 86. A follower member 88 is provided on the control lever 80 at the end remote from the push rod 82. The control lever 80, by the spring 90 fixed to it and to the extension arm 78, is rigidly held in an inoperative position or in a clamping position designated by 80'. The control lever 80 can be transferred from one position into the other and back again by a control link 92 which is only indicated and acts on the follower member 88. In the inoperative position of the control lever 80, the clamping lever 74 is also pivoted into its inoperative position, in which its clamping end 86 lies approximately in the rectilinear extension of the opening lever 72. In the clamping position of the control lever 80, the clamping end 86 of the clamping lever 74, pivoted clockwise, bears against the opening lever 72 or against the marginal section 58 of the printery product 14 clamped between the opening lever 72 and the clamping end 86.

The opening device 60 functions as follows:

When the opening lever 72 is swung back into the product-hold-open position and the clamping lever 74 is located in the inoperative position, the holding arrangement 20 passes into the area of the first feed conveyor 22 (see FIG. 2). In this location, a folded printery product 14, with the fold 32 in front, is fed into the receiving part 46 and dropped so that the fold 32 comes to bear against the base 48. Since the opening lever 72 and the clamping lever 78 are covered by the wall 44, the printery product 14 can slide without problem into the receiving part 46. It should be noted that the marginal section 58 lies on the side of the printery product 14 facing the opening lever 72. In the course of the further transport in conveying direction F, the opening lever 72, under the action of the link 70 on the follower roller 66, is transferred into the product closed position 72', as a result of which the printery product 14 is clamped between the opening lever 72 and the wall 42. The follower member 88 now runs onto the control link 92, which exerts a force, directed from the top downward, on this follower member 88 so that, while the control lever 80 is pivoted anti-clockwise, the clamping lever 74 is transferred clockwise into its clamping position. The marginal section 58 of the printery product 14 is now clamped (indicated by dot-dash line) between the opening lever 72 and the clamping end 86 of the clamping lever 74, the compression spring 84 ensuring that marginal sections 58 of various thickness are satisfactorily clamped in place. The opening lever 72 is now swung back again into its product-hold-open position, which is brought about by the follower roller 66 running off the link 70. As a result, the part of the printery product 14 having the marginal section 58 is carried along and the other part of the printery product 14 remains bearing against the wall 42, since the latter is inclined relative to the vertical. The printery product 14 thus opened passes into the area of the second feed conveyor 22' (see FIG. 2), where a second printery product 14' is inserted into this printery product 14. As soon as this has taken place, the opening lever 72 is pivoted again in an analogous manner into the product-closed position, and the clamping lever 74 is transferred into its inoperative position, as a result of which the printery product 14, with the printery product 14' inserted in between, is folded together and bears against the wall 42. The opening lever 72 is then again swung back into its product-hold-open position, and the printery products 14, 14' inserted one into the other can be seized by a gripper 28 of the removal conveyor 24 and carried away (see FIG. 2).

In FIG. 6, the opening device 60 is shown during the collection of printery products 14 according to FIG. 1. During this procedure, the opening lever 72 and the clamping lever 74 remain in their product-hold-open or inoperative position. The opened printery products 14, 14' can thus be deposited astride onto the supports 12 and fed to the removal conveyor 24.

In order to enable printery products 14 having another format to be opened, the base 48 is preferably adjustable so that the particular marginal section 58 comes to lie in the area of the clamping lever 74. It should be noted that, with the apparatuses shown in FIGS. 1 to 6, printery products 14, 14' can be collected, assembled or inserted one into the other without having to make substantial changes to the apparatus. Thus, for example, the guide plate 50, the link 70 and the control link 92, depending on the processing to be carried out on the printery products 14, 14', can be moved from an active into a non-active position or back by means of a control system, as a result of which, with minimum outlay, printery products can be assembled in a collected manner or inserted one into the other by the same apparatus. In the apparatuses described, the supports 12 and receiving part 46 are each alternately arranged one behind the other. But it would also be conceivable for the supports 12 to be removably fixed (as illustrated in FIG. 4 with the broken lines) to the holding arrangements 20 so that they are removed from the latter when the apparatus is changed over from collecting to assembly or insertion and are replaced by essentially V-shaped receiving parts 46. The supports 12 and also the receiving parts 46 are always directed upward on the effective conveying stretch along the processing path, but they are perfectly able to assume an inclined position relative to the vertical direction. It is also conceivable, with the opening device 60, for even printery products 14 which have no protruding marginal section 58 to be opened. The clamping lever 74 is then to be designed in such a way that its clamping end 86 can plunge between the two parts of the folded printed sheet 14.

It is also readily conceivable for the printery products 14, 14' to be deposited astride onto the supports 12 or fed into the receiving parts 46 by means of known feeders. It is also possible for a lower part of the wall 44 to be arranged rotationally fast on the shaft 62 and for the clamping lever 74 to be mounted on this part of the wall 44 at its end area remote from the shaft 62. Of course, the pocket-shaped receiving part 46 can also be arranged on holding arrangements 20 so that the side walls 42, 44, facing one another, of adjacent receiving parts 46 each form a support 12 at least in the area of the processing path.

The opening device described in detail above can also be used in other insertion machines with which the collecting of printery products is not possible. Since the product part to be swung away is seized and carried along in the case of this opening device, the receiving parts can be arranged in an essentially upright position.

I claim:

1. An apparatus for collecting, assembling and inserting printery products comprising;

a plurality of circulating, saddle-shaped supports, arranged transversely to a circulating direction and at a mutual distance apart, for collecting printery products along a processing path, the supports being directed upward in an area defined by the processing path;

at least two feeding means which are arranged at a distance from one another along the processing path and which deposit printery products astride onto the supports or onto the printery products already deposited onto these supports, wherein the feeding means comprise circulatingly driven feed conveyors including individually controllable grippers arranged on a circulatingly driven tension member to releasably seize the printery products at their folds for depositing them onto the supports and at their open lateral edge opposite the fold for feeding them into the receiving parts, wherein the feed direction of the conveyors essentially corresponds with the circulating direction;

a removal location arranged downstream from these feeding means;

a plurality of circulating receiving parts, closed off at a bottom portion and arranged transversely to the circulating direction, for assembling or inserting printery products, said receiving parts arranged along the processing path, the openings of said receiving parts being directed upward in the area of the processing path such that the printery products can be fed into the receiving parts by the feeding means; and wherein said feeding means move the printery products essentially in the circulating direction while preforming one of depositing them on the supports and feeding them into the receiving parts.

2. The apparatus as claimed in claim 1, wherein at least one of the supports and the receiving parts is removably mounted to holding arrangements included in the apparatus.

3. The apparatus as claimed in claim 2, wherein the supports and the receiving parts are interchangeable.

4. The apparatus as claimed in claim 1 further comprising a traction member driven in a circulating manner and means for coupling at least one of the receiving parts and the supports to the traction member.

5. The apparatus as claimed in claim 1, wherein a carousel-like supporting arrangement, rotatable about an essentially vertical axis, is provided for the supports and receiving parts.

6. The apparatus as claimed in claim 1, wherein the receiving parts and supports are alternately arranged one behind the other as viewed in the direction of the processing path.

7. The apparatus as claimed in claim 6, wherein each support is in alignment with a pair of the adjacent walls of two adjacent receiving parts.

8. The apparatus as claimed in claim 6, wherein, each support covers a pair of adjacent walls of two adjacent receiving parts.

9. The apparatus as claimed in claim 1, wherein, to insert printery products, there is allocated to each receiving part an opening device for opening at least in each case the first printery product inserted into it.

10. The apparatus as claimed in claim 1 wherein the mutual distance between the grippers is essentially the same as the distance between the supports.

11. The apparatus as claimed in claim 1 further comprising an opening means which is active to open the printery products seized by the grippers at their folds for collecting them and which is inactive for feeding the printery products into the receiving parts for assembling or inserting them.

12. The apparatus as claimed in claim 2, wherein the supports are alternately usable.

13. An apparatus for collecting, assembling and inserting printery products comprising;

a plurality of circulating, saddle-shaped supports, arranged transversely to a circulating direction and at a mutual distance apart, for collecting printery products along a processing path, the supports being directed upward in an area defined by the processing path;

at least two feed locations which are arranged at a distance from one another along the processing path and at which printery products can be deposited astride onto the supports or onto the printery products already deposited onto these supports;

a removal location arranged downstream from these feed locations;

a plurality of circulating receiving parts, closed off at a bottom portion and arranged transversely to the circulating direction, for assembling or inserting printery products, said receiving parts arranged along the processing path, the openings of said receiving parts being directed upward in the area of the processing path such that the printery products can be fed into the receiving parts at the feed locations; and an opening device allocated to each receiving part for opening at least in each case the first printery product inserted into it in order to insert further printery products;

wherein at least some of the printery products are folded at a fold outside the center and one part of which, at an open lateral edge opposite the fold, has a marginal section protruding relative to another part, and wherein the opening device comprises at least one opening member which can be moved from a product-hold-open position into a product-closed position and back again and on which a driving element is provided for detachably holding the one part of the product in position.

14. The apparatus as claimed in claim 13 wherein the driving element detachably holds the one part of the product in position at its marginal section.

15. The apparatus as claimed in claim 13, wherein the opening member comprises a lever which is mounted adjacent a base portion of the receiving part about an axis running approximately in a longitudinal direction defined by the receiving part such that the lever can be pivoted by means of a drive arrangement from the product-hold-open position into the product-closed position and back again and in whose free end area the driving element is arranged.

16. The apparatus as claimed in claim 13, wherein, when printery products are being collected and the opening member is located in the product-hold-open position, the opening member and the driving element are covered by the adjacent support.

17. The apparatus as claimed in claim 13, wherein the receiving part is formed by a first wall arranged in a fixed position and a second wall forming the opening member and, in a base portion of the receiving part, pivotably mounted about an axis running approximately in a longitudinal direction defined by the receiving part, in the free end area of which wall the driving element is arranged and which wall can be pivoted from the product-hold-open position into the product-closed position and back again by means of a drive arrangement.

18. The apparatus as claimed in claim 15, wherein the driving element comprises a clamping lever which is pivotably mounted in the free end area of the lever and can be pivoted from an inoperative position, running essentially in the direction of the lever, into a clamping position, in which, at least with its clamping end, the clamping lever bears against the lever or the second wall or against the marginal section, and back by means of a control arrangement acting on it.

19. The apparatus as claimed in claim 15, wherein the distance between the base portion of the receiving part and a pivot axis defined by the lever is variable.

20. An opening device for opening at least a first printery product disposed into a pocket-shaped receiving part, in order to allow further printery products to be inserted into the first, opened printery product, wherein the pocket-shaped receiving part defines a closed bottom portion, and wherein the first printery product defines a fold and rests with the fold on the closed bottom portion, said fold positioned to define one part of the printery product which, at an open lateral edge opposite the fold, has a marginal section protruding relative to anther non-protruding part, wherein the opening device comprises:

at least one opening member which can be moved from a product hold-open position into a product-closed position and back again and on which a clamping lever is provided for detachably holding the one part of the product in position at its marginal section such that the printery product may be opened without clamping the other non-protruding part.

21. The apparatus as claimed in claim 20 wherein the opening member comprises a lever which is mounted adjacent a base portion of the receiving part about an axis running approximately in a longitudinal direction defined by the receiving part such that the lever can be pivoted by means of a drive arrangement from the product-hold-open position into the product-closed position and back again and in whose free end area the driving element is arranged.

22. An opening device for opening at least a first printery product disposed into a pocket-shaped receiving part, in order to allow further printery products to be inserted into the first, opened printery product, wherein the pocket-shaped receiving part defines a closed bottom portion, and wherein the first printery product defines a fold and rests with the fold on the closed bottom portion, said fold positioned to define one part of the printery product which, at an open lateral edge opposite the fold, has a marginal section protruding relative to another part, wherein the opening device comprises:

at least one opening member which can be moved from a product-hold-open position into a product-closed position and back again and one which a driving element is provided for detachably holding the one part of the product in position; and wherein when printery products are being collected and the opening member is located in the product-hold-open position, the opening member and the driving element are covered by an adjacent support.

23. An opening device for opening at least a first printery product disposed into a pocket-shaped receiving part, in order to allow further printery products to be inserted into the first, opened printery product, wherein the pocket-shaped receiving part defines a closed bottom portion, and wherein the first printery product defines a fold and rests with the fold on the closed bottom portion, said fold positioned to define one part of the printery product which, at an open lateral edge opposite the fold, has a marginal section protruding relative to another part, wherein the opening device comprises:

at least one opening member which can be moved from a product-hold-open position into a product-closed position and back again and on which a driving element is provided for detachably holding the one part of the product in position; and wherein the receiving part is formed by a first wall arranged in a fixed position and a second wall forming the opening member and, in a base portion of the receiving part, pivotably mounted about an axis running approximately in a longitudinal direction defined by the receiving part, in the free end area of which wall the driving element is arranged and which wall can be pivoted from the product-hold-open position into the product-closed position and back again by means of a drive arrangement.

24. The apparatus as claimed in claim 23 wherein the driving element comprises a clamping lever which is pivotably mounted in the free end area of the lever and can be pivoted from an inoperative position, running essentially in the direction of the lever, into a clamping position, in which, at least with its clamping end, the clamping lever bears against the lever or the second wall or against the marginal section, and back by means of a control arrangement acting on it.

25. An opening device for opening at least a first printery product disposed into a pocket-shaped receiving part, in order to allow further printery products to be inserted into the first, opened printery product, wherein the pocket-shaped receiving part defines a closed bottom portion, and wherein the first printery product defines a fold and rests with the fold on the closed bottom portion, said fold positioned to define one part of the printery product which, at an open lateral edge opposite the fold, has a marginal section protruding relative to another part, wherein the opening device comprises:

at least one opening member which can be moved from a product-hold-open position into a product-closed position and back again and on which a driving element is provided for detachably holding the one part of the product in position wherein the opening member comprises:

a lever which is mounted adjacent a base portion of the receiving part about an axis running approximately in a longitudinal direction defined by the receiving part such that the lever can be pivoted by means of a drive arrangement from the product-hold-open position into the product-closed position and back again and in whose free end area the driving element is arranged; and wherein the distance between the base portion of the receiving part and the pivot axis defined by the lever is variable.

26. An apparatus for collecting, assembling and inserting printery products comprising;

a plurality of circulating, saddle-shaped supports, arranged transversely to a circulating direction and at a mutual distance apart, for collecting printery products along a processing path, the supports being directed upward in an area defined by the processing path;

at least two feeding means which are arranged at a distance from one another along the processing path and which deposit printery products astride onto the supports or onto the printery products already deposited onto these supports;

a removal location arranged downstream from the feeding means, said removal location including a removal conveyor for carrying away collected, assembled, or inserted products;

a plurality of circulating receiving parts, closed off at a bottom portion and arranged transversely to the circulating direction, for assembling or inserting printery products, said receiving parts arranged along the processing path, the openings of said receiving parts being directed upward in the area of the processing path such that the printery products can be fed into the receiving parts by the feeding means;

a guide plate in the area of the base portion of the receiving parts wherein the guide plate lifts the assembled or inserted printery product toward the removal location; and wherein said feeding means move the printery products essentially in the circulating direction while preforming one of depositing them on the supports and feeding them into the receiving parts.

* * * * *

UNITED STATES PATENT AND TRADEMARK OFFICE

CERTIFICATE OF CORRECTION

PATENT NO. : 5,104,108

DATED : April 14, 1992

INVENTOR(S) : WERNER HONEGGER

It is certified that error appears in the above-identified patent and that said Letters Patent is hereby corrected as shown below:

ON THE TITLE PAGE

Under the heading "Foreign Application Priority Data," in the first line, please delete "02285/88" and substitute therefor --02285/88-3--.

Column 1, line 36, after "products" please insert --.--.

Column 6, line 22, after "and at" please insert --the--.

Column 7, line 20, please delete "product closed" and substitute therefor --product-closed--.

Claim 20, line 11, please delete "anther" and substitute therefor --another--.

UNITED STATES PATENT AND TRADEMARK OFFICE

CERTIFICATE OF CORRECTION

PATENT NO. : 5,104,108

DATED : April 14, 1992

INVENTOR(S) : WERNER HONEGGER

It is certified that error appears in the above-identified patent and that said Letters Patent is hereby corrected as shown below:

Claim 22, line 15, please delete "one" and substitute therefor --on--.

Signed and Sealed this

Nineteenth Day of April, 1994

*Attest:*

Bruce Lehman

BRUCE LEHMAN

*Attesting Officer*

*Commissioner of Patents and Trademarks*